United States Patent [19]

Vitols et al.

[11] 4,336,697

[45] Jun. 29, 1982

[54] METHOD OF AND MECHANISM FOR TRANSFERRING KNITTED FABRIC FROM A KNITTING MACHINE TO A MAGAZINE

[76] Inventors: Reinhards Vitols, 12 Sunningdale Dr., Tollerton, Nottinghamshire; Adrian M. Woodward, 22 Abbortsburg Close, Rise Park, Bulwell, Nottinghamshire; John E. Baker, 42 Park Rd., Birstall, Leicester; Gordon R. Wray, Stonestack, Main St., Rempstone, Nottinghamshire, all of England

[21] Appl. No.: 91,190

[22] Filed: Nov. 5, 1979

[30] Foreign Application Priority Data

Nov. 6, 1978 [GB] United Kingdom ..... 43366/78

[51] Int. Cl.[3] ..... D04B 9/40; D04B 35/00

[52] U.S. Cl. ..... 66/148

[58] Field of Search ..... 66/147, 148

[56] References Cited

U.S. PATENT DOCUMENTS

| | | | |
|---|---|---|---|
| 3,349,576 | 10/1967 | Borne | 66/148 |
| 3,446,042 | 5/1969 | Fontaine | 66/148 |
| 3,633,385 | 1/1972 | Bruelemans | 66/148 |

*Primary Examiner*—Ronald Feldbaum

*Attorney, Agent, or Firm*—Charles E. Brown

[57] ABSTRACT

The present invention provides a method of and mechanism for transferring a knitted fabric from the knitting needles (28) of a flat knitting machine (10) to the needles (38) of a magazine bar (21).

One of the beds (12) of the machine is dropped slightly and the tips of transfer elements (24) are brought into juxtaposition with the needles (28). The tips of the elements (24) are then engaged in the eyes of the needles (28) which are then withdrawn to transfer the loops of the fabric to the elements (24). The latter are then moved into engagement with the needles (38) of the magazine bar (21) and the loops transferred to the magazine needles by means of teeth (52) of a member (50) which engage and carry the loops from the elements (24) to the needles (38).

17 Claims, 17 Drawing Figures

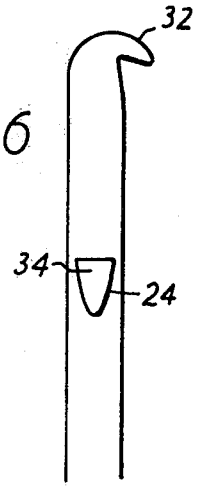
FIG. 6
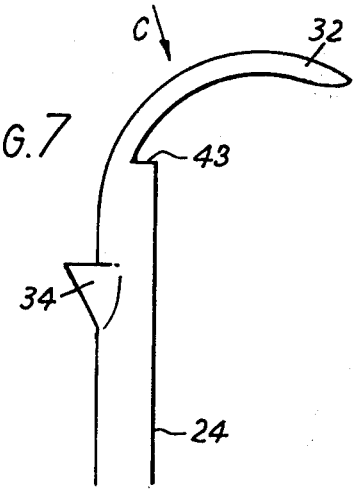
FIG. 7
FIG. 8
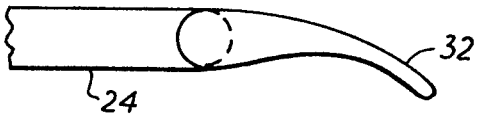
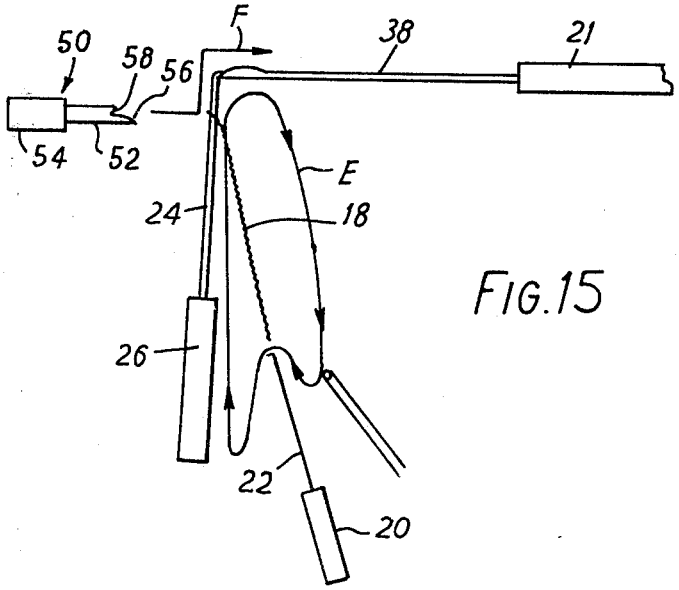
FIG. 15

METHOD OF AND MECHANISM FOR TRANSFERRING KNITTED FABRIC FROM A KNITTING MACHINE TO A MAGAZINE

The present invention relates to flat knitting machines.

In particular the present invention relates to transfer mechanisms for attachment to a flat knitting machine to provide automatic transfer of a knitted fabric from the knitting needles of the machine to points on a magazine bar.

It is normal practice for knitted garments to be manufactured with borders which are stronger and more resilient than the remainder of the garment fabric and in most instances the borders and the main portions of a garment are knitted on separate machines and subsequently joined together. This has necessitated transferring the stitches of the last-knitted course in a knitted border to the points of a magazine bar. Initially the transfer was accomplished manually, requiring considerable skill and being a time-consuming operation.

The present invention seeks to provide an improved form of transfer mechanism.

Accordingly the present invention provides a method of transferring a knitted fabric from the knitting needles of a flat knitting machine to the needles of a magazine bar characterised by the steps of displacing one bed of the knitting machine a preselected distance from a position in which knitting takes place; moving a plurality of intermediate transfer elements into juxtaposition with the needles of said one bed and engaging each said element with a respective needle and transferring the knitted loops of said knitted fabric from the needles of said one bed to said elements; removing said elements from adjacent the needles of said one bed and into engagement with the needles of said magazine bar; and transferring the loops of the knitted fabric from said elements to the needles of said magazine bar.

The present invention further provides a mechanism for attachment to a flat knitting machine for transferring knitted fabric from the knitting needles of one bed of the machine to the needles of a magazine bar characterised in that there is provided a plurality of intermediate transfer elements each of which is engageable with a respective one of said knitting needles for enabling transfer of the knitted loops of said fabric from said knitting needles to said elements; first means for moving said elements into and subsequently out of engagement with said knitting needles and for subsequently moving said elements into engagement with said needles of the magazine bar; and second means for sweeping the loops of said knitted fabric from said intermediate transfer elements onto the needles of the magazine bar.

The present invention also provides a kit of parts for a transfer mechanism as described in the immediately preceding paragraph.

The present invention further provides a flat knitting machine including a mechanism as described in the second preceding paragraph.

A transfer mechanism according to the present invention has the advantage of simplicity and is therefore relatively inexpensive to produce, and can be fitted to virtually any flat knitting machine having stitch transfer facility from rear to front or vice versa and for operation therewith.

The present invention is further described hereinafter, by way of example, with reference to the accompanying drawings, in which:

FIG. 6 is a rear elevation of an intermediate transfer element;

FIG. 7 is a side elevation of the element of FIG. 6;

FIG. 8 is a view in the direction of arrow C of FIG. 7;

FIG. 15 is a view showing the transfer of a knitted border to a magazine bar.

Figure 1:
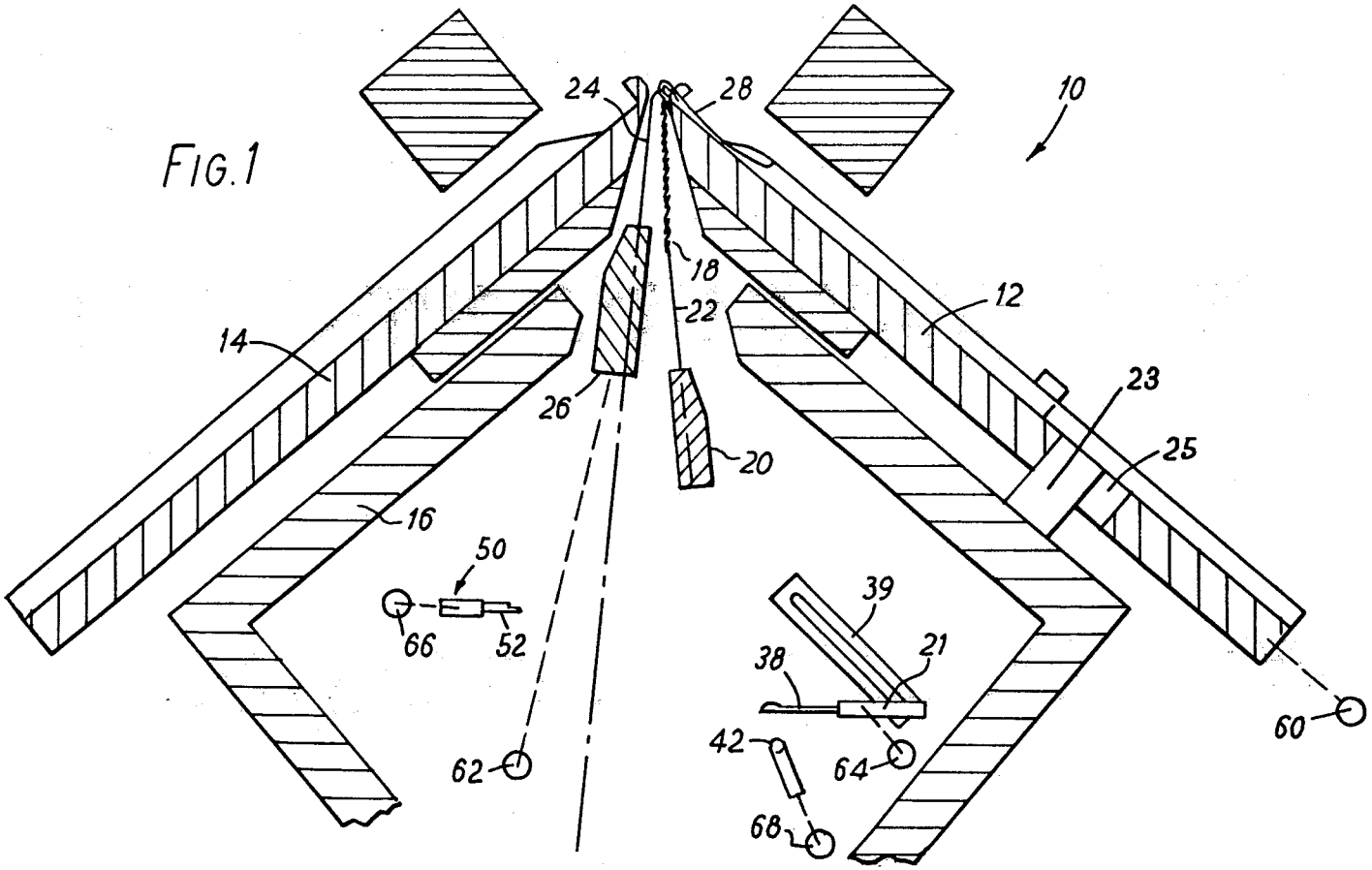
FIG. 1 is a side elevation of a portion of a flat knitting machine having a transfer mechanism according to the present invention.

Referring to the drawings and initially to FIGS. 1 to 5 there is shown a portion 10 of a conventional flat knitting machine having stitch transfer facility and two flat needle beds 12, 14 arranged in an inverted V-shape and mounted on a frame 16. Knitting is effected by traversing a carriage (not shown in the drawings) back and forth along the needle beds and drawing off the knitted fabric 18 by means of a draw-off bar 20 set with hooks 22 which engage in the first knitted course. The latter could be a conventional drawthread or production fibre to be unroved at a later stage. The draw-off force applied to the knitted fabric is determined generally by weights attached to the bar 20 or the weight of the bar itself.

A preferred transfer mechanism according to the present invention is attached to the flat knitting machine and automatically transfers a knitted border from the knitting needles of the needle beds to a magazine bar 21 which is detachably mounted on the frame 16 below the needle beds 12, 14 and here is shown arranged substantially horizontally in its rest position. The transfer mechanism includes a plurality of parallel intermediate transfer elements 24 (only one of which can be seen in the drawings) arranged in a common plane and mounted on a carrier 26 for movement beneath the needle beds 12, 14.

Figure 3:
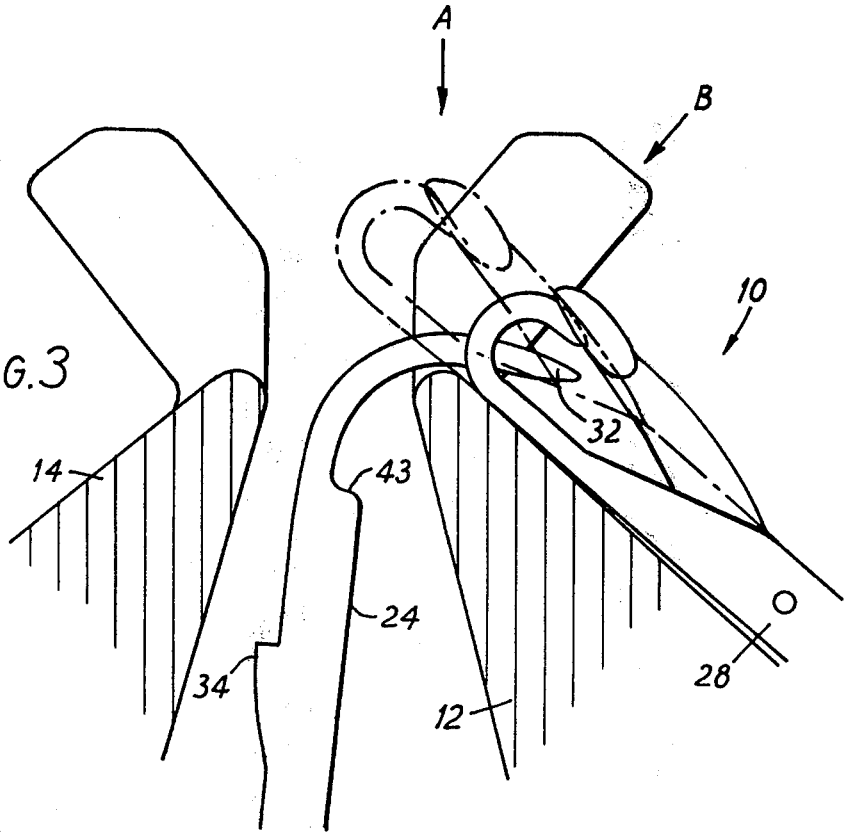
FIG. 3 is a view similar to FIG. 2 showing the needle in a withdrawn position with its needle bed in its normal position.

As is best seen in FIGS. 1 and 3 the two needle beds are fitted with latch needles 28 (only one being shown on bed 12 for clarity) which cooperate during the knitting of a garment border in a conventional manner when the carriage traverses the beds 12, 14.

Figure 2:
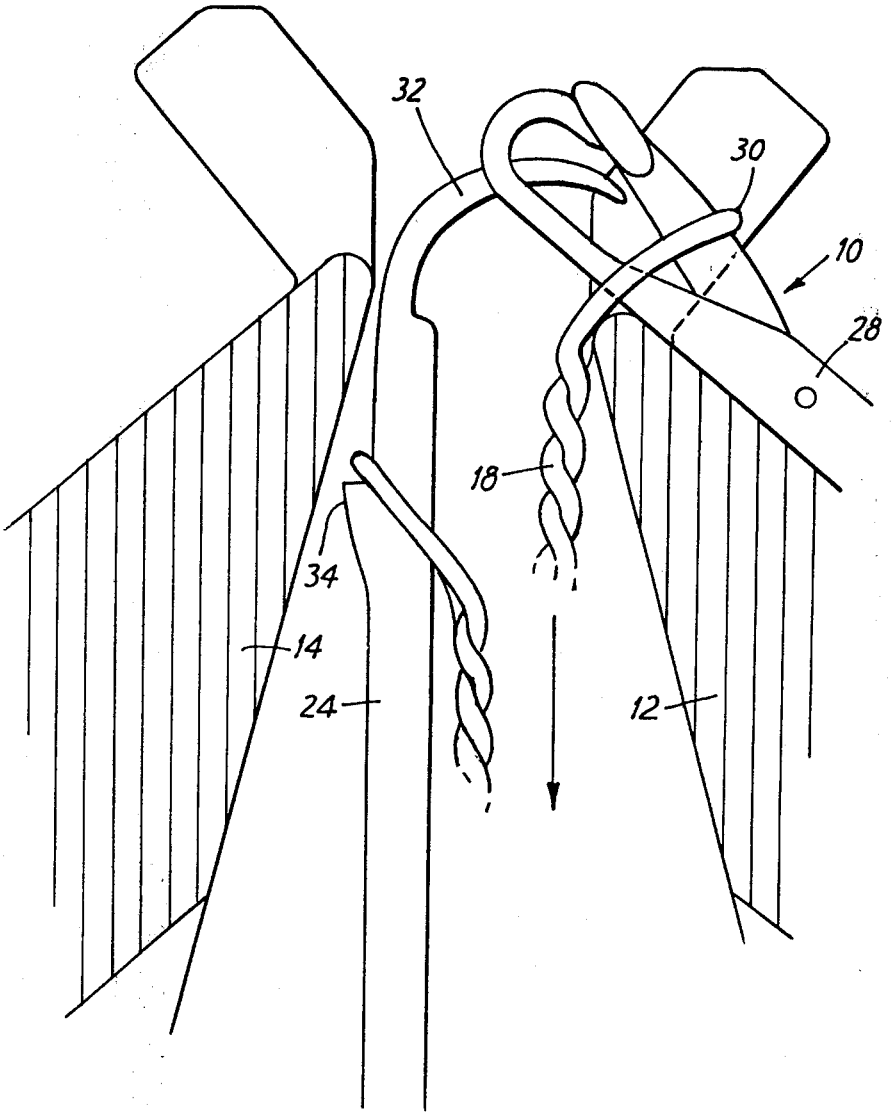
FIG. 2 is an elevation showing the free end portion of an intermediate transfer element in engagement with a needle of the flat knitting machine the needle being in a raised position and its needle bed being in a dropped position.

When the last course of the border is knitted the loops of the border are transferred from one to the other bed needles and a slack course is knitted onto the loops as is normal practice. While the transfer could be effected from front to rear bed needles, for convenience we shall consider the transfer being effected from rear to front bed 12 needles. The border is then ready to be transferred to the magazine bar 21. The front bed 12 is dropped slightly (FIG. 2 shows the bed in its dropped position) by moving the bed in its own plane both laterally along, and substantially at right angles to its longitudinal axis. The movements in these two directions may be effected either in separate stages or preferably simultaneously by suitable cam means or hydraulics, the bed 12 being guided by pins 23 (only one of which is shown) locating in slots 25 or grooves in the bed 12, or other suitable means. It is important that the needles on the bed 12 do not foul those on the bed 14 but should allow easy engagement with the transfer elements 24, as is described below, and for this a lateral movement of ½ needle pitch (the pitch is the gap between adjacent needles) is preferable. Typically the bed 12 moves 2 mm laterally and 4 mm at right angles to its longitudinal axis. The carriage, with its lowering cam set to its minimum position, is than transversed along the needle beds pushing the front bed needles out into the tuck position. No yarn is fed to the needles at this stage since the yarn carrier is disengaged. The operation to this point is capable of being carried out on a conventional flat knitting machine, the bed dropping facility being provided by a simple modification to the machine. FIG. 2 shows one of the needles 28 in the tuck position with the loops 30 retained just over the closed latches of the needles.

Figure 5:
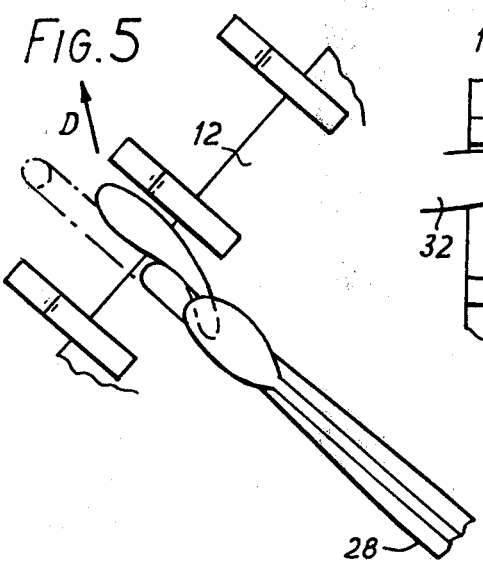
FIG. 5 is a view in the direction of arrow B of FIG. 3.
Figure 4:
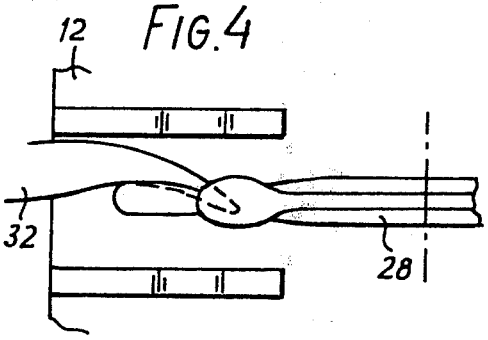
FIG. 4 is a view in the direction of arrow A of FIG. 3.
Figure 9:
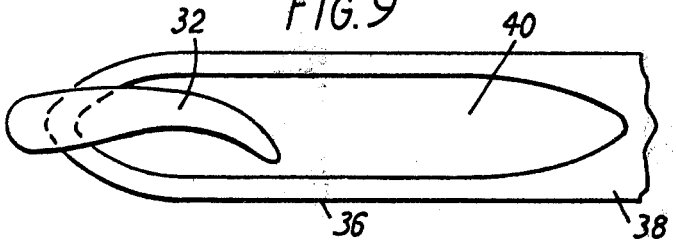
FIG. 9 is a plan view of an end portion of a preferred point on a magazine bar engaged with the element of FIGS. 6 to 8.

Preferably simultaneous with the dropping of the bed 12 the carrier 26 is raised by suitable means to bring the points 32 of the intermediate transfer elements 24 into juxtaposition with the respective needles 28. The carrier is initially located below and slightly to one side of the gap between the two needle beds and is raised at an angle of approximately 4° to the vertical to bring the points 32 of the elements 24 into the position shown in FIG. 2, where the point 32 of each transfer element 24 lies adjacent and to one side of the eye of a respective latch needle 28. As is best seen in FIGS. 5 and 8 the point of each transfer element is curved slightly so that each point 32 curves towards the eye of the associated latch needle 28 in the position shown in FIG. 2. The raising of the carrier 26 at this slight angle to the vertical is effected to ensure that the transfer elements 24 do not foul the draw-off bar 20 or its hooks 22. The bed 12 is then raised (in the direction of arrow D, FIG. 5), returning it to its initial normal knitting position, thus moving the points 32 into the eyes formed by the closed latches and hooks of the needles 28. Alternatively, both the bed and the carrier 26 or the carrier 26 alone may be moved to produce the desired effect. In FIGS. 3 and 5 the tuck position of the needles is shown in dotted lines.

This return movement of the bed 12 effectively moves the elements 24 towards the back of the eyes in the needles 28.

The carriage is then passed across the needle beds 12 and 14 to return the needles 28 to their normal press-off or knock over position, shown in solid lines in FIG. 3. The withdrawal of the needles causes the loops 30 to slide off the needles 28 onto the elements 24 thus completing the transfer of the knitted border to the transfer elements, and also partially deflects the points 32 out of the needle eyes to ensure that the loops 30 do not catch on any needle points 32 which might initially have projected through the eyes. Once the needles have been withdrawn the bed 12 is again lowered to move the needles 28 clear of the transfer elements 24. The latter are sufficiently flexible to allow for their deflection out of the needle eyes during this movement. The carrier 26 with the transfer elements is then removed from the knitting zone to a location below the needle beds 12, 14, the draw-off bar 20 moving in unison with the carrier 26 to maintain some tension on the knitted border. Stops 34 (only one of which is shown) are provided on the elements 24 to prevent the loops 30 being drawn down the elements 24 and consequent stretching of the loops.

Figure 10:
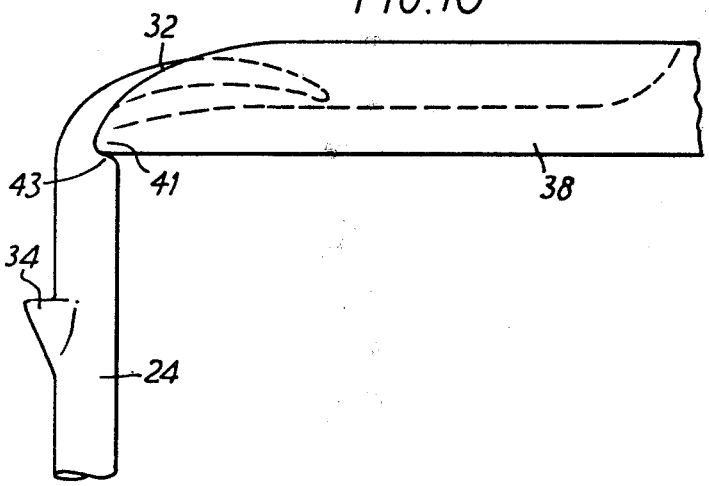
FIG. 10 is a side elevation of the point of FIG. 9 with the element of FIGS. 6 to 8 engaged.
Figure 11:
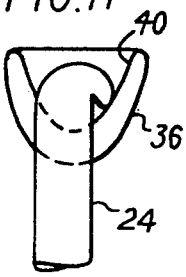
FIG. 11 is an end elevation of the point of FIG. 9 with the element of FIGS. 6 to 8 engaged.
Figure 12:
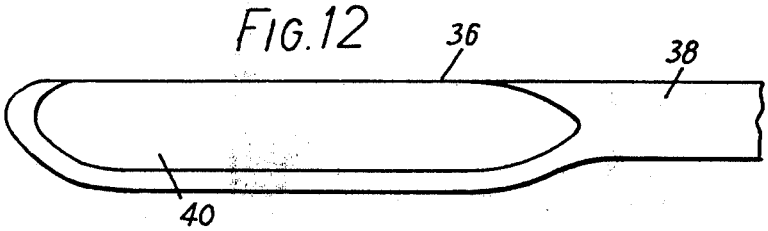
FIG. 12 is a plan view of a further form of point to that shown in FIGS. 9 to 11.
Figure 13:
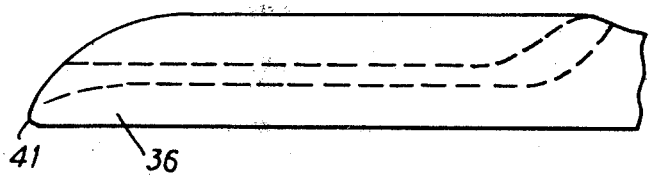
FIG. 13 is a side elevation of the point of FIG. 12.
Figure 14:
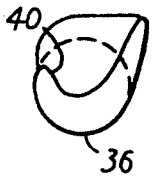
FIG. 14 is an end elevation of the point of FIG. 12.

Simultaneous with or subsequent to the lowering of the carrier 26 the magazine bar 21 is moved from its initial rest position below and to one side of the gap between the two needle beds (as shown in FIG. 1) to bring a point 36 (FIGS. 9–13) of a respective transfer element 38 on the magazine bar 21 into engagement with the point 32 of each transfer element 24. As is best seen in FIG. 10 the elements 24 and 38 are oriented generally at right angles to one another with the point 32 of each element 24 engaged in a recess 40 in the point 36 of each element 38. The most convenient orientation of the magazine bar 21 is horizontal and the latter is conveniently moved upwardly along guides 39 at an angle of approximately 30° to the horizontal to engage the points 36 and 32. In addition, the tip 41 of each element 38 engages in a recess 43 in the respective intermediate transfer element 24 to ensure a smooth transfer of the loops to the magazine bar.

Transfer of the loops from the transfer elements 24 to the elements 38 on the magazine bar 21 is effected by means of a comb-like member 50 (FIG. 15) which comprises a plurality of teeth 52, equal in number to the maximum number of loops which may need to be transferred, rigidly supported on a bar 54 parallel with the carrier 26 and magazine bar 21. The member 50 is located on the side of the carrier 26 opposite to that of the magazine bar 21 with the teeth 52 generally horizontal when in their rest position. Once the elements 24 and 38 are engaged ready for transfer the member 50 is moved toward the elements 24 with each tooth 52 aligned with a respective loop. Each tooth 52 has an end portion 56, the movement forward of the member 50 being sufficient to engage each end portion 56 in a respective loop. The member 50 is then raised to pull the loops to the tips of the elements 24 and moved forward again engaging each loop with a shoulder 58 on each tooth 52 and driving the loops onto the elements 38 of the magazine bar 21. The movement of the teeth 52 is thus along a path indicated by arrow F (FIG. 15). Simultaneous with or subsequent to the movement of the member 50 the knitted border is disengaged from the draw-off bar 20 by means of a bar 42 which is paralleled with the magazine bar and moves in a continuous generally circular path E as shown in FIG. 15. Conveniently the bar 42 also serves to sweep the knitted border towards the rear of the elements 38 during movement along the upper part of the path E. Movement of the bar 42 is conveniently synchronised with movement of the member 50 to ensure that the knitted border is swept off the hooks of the draw-off bar 20 as the member 50 is raised to transfer the loops to the elements 38.

The draw-off bar 20 may of course be disengaged from the knitted border prior to the transfer.

The transfer can alternatively be effected for example either by a rotary brush which brushes the loops onto the elements 38.

Once the transfer to the magazine bar is complete the magazine bar 21, the member 50, and the carrier 26 are returned to their rest position ready to commence a further cycle of operation.

A further means of effecting the transfer comprises the use of a bar paralleled with the magazine bar and carrying a plurality of teeth projecting at right angles to the bar axis in one or more (preferably three) aligned sets. The bar is rotated so that the teeth sweep the loops from the intermediate transfer elements onto the magazine bar. The teeth are preferably rounded at their outer ends or have cam surfaces presenting smooth surface to the fabric.

Once a sufficient number of borders have been accumulated on the magazine bar it is removed and replaced by a fresh bar. This can be effected automatically with a counter indicating the number of borders on a magazine bar and tripping a magazine bar change once a predetermined count is reached.

Movement of the bed 12, the carrier 26, magazine bar 21, member 50 and bar 42 are conveniently effected by respective means 60 to 68 and may be for example motor driven rotatable cams coupled to the movable parts of the transfer mechanism by suitable cam followers and levers. Hydraulically or pneumatically operated piston-cylinder units or electromagnetic means may be used to drive the bed 12 and the carrier 26 etc, indeed any suitable means may be used. Synchonised movement may be effected by using a common drive source.

Figure 1A:
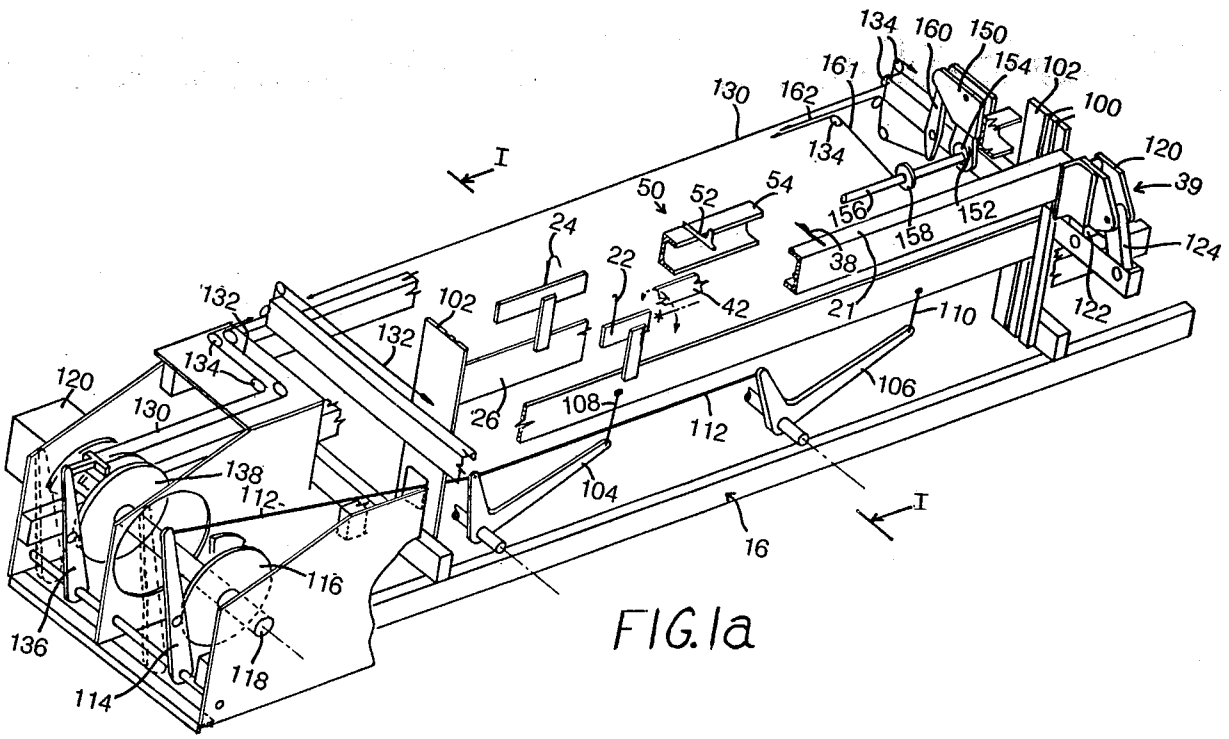
FIG. 1A is a perspective plan view showing drive arrangement of elements of the present invention.
Figure 1B:
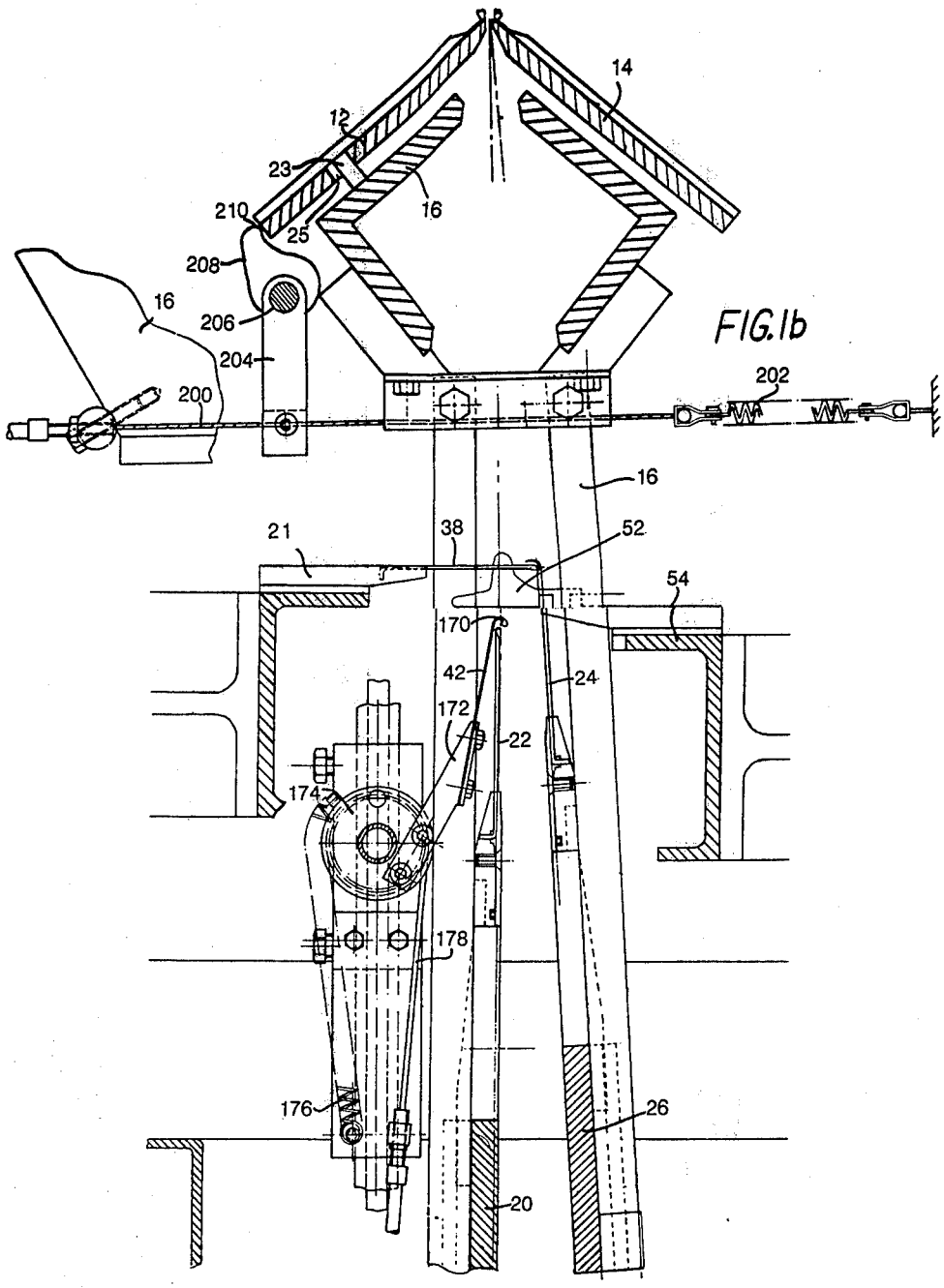
FIG. 1B is a side elevational view of the drive mechanism of the present invention.

Referring now to FIGS. 1A and 1B these show a preferred form of the invention which sets forth in detail the drive mechanism. In FIG. 1A the various members are shown partially broken away to aid clarity.

Referring to the operation of the draw-off bar 20 and carrier 26 for the intermediate transfer elements 24, each is vertically slidable in respective grooves 100 and 101 formed in vertical end plates 102 mounted on the frame 16. Both the draw-off bar 20 and the carrier 26 are operated by identical mechanisms and therefore only that for the draw-off bar 20 is described. The draw-off bar operating mechanism comprises two crank levers 104 and 106 pivotable about horizontal axes extending perpendicular to the draw-off bar 20. One arm of each crank lever 104, 106 is coupled to the draw-off bar 20 located above the levers by way of respective rods 108, 110, the rods being pivotally mounted both to the draw-off bar and the crank levers 104, 106. The other arms of the crank levers are secured together by way of a single cable 112 and to one end of an operating lever 114 whose other end is pivotally mounted on the frame 16. The lever 114 is pivoted about its pivot axis by means of a rotatable cam 116, the cam being secured on a cam shaft 118 rotatably and intermittently driven by means of a drive motor 120 suitably geared to the cam shaft 118. Rotation of the cam 116 will, at a preselected angular position of the cam, pivot the lever 114 to the left as seen in FIG. 1A. This pivots the crank levers 104 and 106 in an anti-clockwise direction to raise the draw-off bar 20. Further rotation of the cam 116 allows the lever 114 to pivot to the right under the action of suitable biasing strings thus allowing the crank levers to pivot clockwise under the weight of the draw-off bar 20 which thus is lowered. Lowering of the draw-off bar may conveniently be assisted using suitable biasing strings. Movement of the carrier 26 is effected in exactly the same manner by a further operating lever and cam on the cam shaft 118.

The magazine bar 21 is secured at each end to the guide mechanism 39 which comprises a bracket 120 secured to the magazine bar 21 and pivotally mounted on the frame 16 by means of two levers 122, 124, the pivot positions of the levers being such to provide the magazine bar 21 with a substantially rectilinear movement in a direction towards and away from the transfer elements 24 at a preselected angle to the horizontal. The magazine bar 21 is biased into its lowermost position by suitable biasing springs and is drawn upwards to engage the points 36 of each transfer element 38 with the points 32 of each intermediate transfer element 24 by means of a cable and pulley system. A respective cable 130,132 is secured to the magazine bar 21 at or adjacent each end thereof or to the brackets 120 and passes around a number of pulleys 134 to connect with a further operating lever 136 pivotally mounted with the lever 114. The lever 136 is also pivoted under the influence of a cam 138 on the cam shaft 118, the lever 136 being spring biased into abutment with the cam 138.

The bar 54 of the comb-like member 50 is secured at each end to a respective bracket 150 which is pivoted on the upper end of a substantially vertically oriented support limb 152. The limb 152 has a through bore in its lower end region in which a cam 154 is rotatably received. The cam is eccentrically secured on a shaft 156 which extends substantially parallel to the bar 154 and is rotatably mounted at each end on the frame 16. The shaft 156 also carries a pulley 158 to which a cable 160 is attached, the cable being secured at a preselected point on the circumference of the pulley 158. The cable 160 is guided around further pulleys 134 to a further operating lever actuated by a cam on the cam shaft 118. Rotation of the cam to displace the associated operating lever to the left rotates the shaft 156 in a clockwise direction as seen in FIG. 1A. The resulting rotation of the cam 154, by virture of the eccentric mounting of the cam raises the bracket 150 and thus the bar 54. At the same time as the shaft 156 is rotated to raise the bar 54 the bracket 150 is also acted on through a first order lever 160 by way of a further cable 162 and an operating lever and cam mounted on the cam shaft 118. The combined effect of the rotation of shaft 156 and pivoting of lever 160 is to move the bar 54 and thus the teeth 52 substantially through the path F shown in FIG. 15 to sweep the knitted loops from the elements 24 on to the elements 38 of the magazine bar 21 which has previously been moved into position.

The bar 42 which serves to disengage the knitted border from the draw-off bar 20 is better seen in FIG. 1B and is in the form of an elongate plate extending substantially parallel with the magazine bar 21, the upper free edge of the plate being formed into a curved flange 170 to present a smooth surface to the knitted border. The plate is supported adjacent each end on respective struts 172 in turn tangentially mounted on respective pulleys 174 rotatably mounted about a common axis extending substantially parallel to the draw-off bar 20. Each pulley 174 is biased towards one extreme angular position by a respective coil spring 176 and is rotatable against the action of the spring by means of a Bowden cable 178. The inner cable of the Bowdern cable is secured at one end to the pulley and at its other end to a further operating lever cooperating with a cam of the cam shaft 118. As will be appreciated from FIG. 1B actuation of the operating lever by the associated cam rotates the pulley 174 clockwise as seen in FIG. 1B to move the plate 42 about a substantially arcuate path.

Although, as will be appreciated from the above description, the draw-off bar 20, magazine 21, carrier 26 and the like have identical mountings at or adjacent each end thereof in order to preserve clarity in FIG. 1A only one set of mounting as shown. In addition only a representative number of the operating levers and cams are shown.

The raising and lowering of the bed 12 of the knitting machine is also effected by means of a Bowden cable 200 whose outer sheath is secured to the frame 16. The inner cable of the Bowden cable is secured at one end to a further operating lever co-operating with a cam on the cam shaft 118 and at its other end to the frame 16 by way of a tension coil spring 202. The exposed end region of the inner cable is also secured adjacent one end of a lever 204 whose other end is rigidly secured to a freely rotatable shaft 206, the shaft being rotatably mounted on the frame 16. The shaft 206 also carries a cam 208 whose cam surface 210 abuts the lower side edge of the needle bed 12. As will be appreciated, the associated operating lever is normally pivoted away from the axis of the cam shaft 118 by its cooperating cam to hold the cam 208 in the position shown in FIG. 1B, thus maintaining the needle bed 12 in its raised position. Rotation of the cam shaft 118 to allow the associated operating lever to pivot towards the cam shaft allows the coil spring 202 to draw the inner cable 20 to the right as seen in FIG. 1B. This pivots the lever 204 and thus the cam 208 is an anti-clockwise direction allowing the needle bed 12 to drop either under its own weight or under the action of suitable biasing springs. The direction of movement of the needle bed 12 is controlled by the pins 23 in the slots 25. The amount of which the needle bed 12 drops is controlled by the extreme anti-clockwise position of the cam 208, or alternatively by positioning of suitable stops.

The timing of the movements of the draw-off bar 20, magazine bar and the like to one another is effected by suitable angular positioning of the various cams on the cam shaft 118. In addition, the drive motor 120 is intermittently operated, the timing of its operation being controlled partly by micro switches on the apparatus to sense the position, for example of the knitting carriage, and partly by the knitting control pattern for the associated knitting machine.

FIGS. 6 to 8 show a preferred form of intermediate transfer element 24. The element is approximately 50.00 mm long with the point 32 projecting approximately 4.5 mm at right angles to the element axis. The point 32 exhibits a radius of curvature of 2.25 mm in a plane substantially at right angles to a plane in which the axis lies and as can be seen in FIG. 7 the point 32 is considerably thinner than the body of the element both providing the recess 43 and a sufficient degree of flexibility in the element about the element axis.

FIGS. 9 to 11 and 12 to 14 shows two different forms of magazine bar element 38. Each element 38 is approximately 70.00 mm long and 1.5 mm thick with an elongate recess 40 at its point 36 approximately 9.5 mm long to receive a point 32 of an intermediate transfer element 24. As is best seen; in FIGS. 11 and 14 the element in FIG. 14 differs from that in FIG. 11 in having one side wall of the recess 40 partially cut away.

To assist in the transfer of loops from the needles 28 to the intermediate transfer elements 24 a suitable form of sweep means (not shown) such as a rotary brush may be provided above the needle bed, the brush rotating in a clockwise direction when viewed as in FIGS. 1 and 2.

Finally, the transfer operation may be commenced by manual actuation of a switch or alternatively automatically once knitting of a border is completed, for example by actuation of a trip switch by the carriage after it has completed its traverse of the needle beds to raise the needles into their tuck positions. Movement of the carrier 26 and the magazine bar 20 may be effected in synchronisation with the carriage, needle and needle bed movement by suitable control gear or cams.

The dimensions given in the above description are by way of example only and may vary between differently gauged machines and even between two machines of the same gauge.

We claim:

1. A method of transferring a knitted fabric from the knitting needles of a flat knitting machine to the needles of a magazine bar comprising the steps of displacing one bed of the knitting machine a preselected distance from a position in which knitting takes place; moving a plurality of intermediate transfer elements into juxtaposition with the needles of said one bed and engaging each said element with a respective needle and transferring the knitted loops of said knitted fabric from the needles of said one bed to said elements; removing said elements from adjacent the needles of said one bed and into engagement with the needles of said magazine bar; and transferring the loops of the knitted fabric from said elements to the needles of said magazine bar.

2. A method as claimed in claim 1 wherein said one bed is displaced both in the direction of its longitudinal axis an amount substantially equal to half the distance separating adjacent needles of the bed, and also in a direction substantially perpendicular to said axis and substantially in the plane of the bed.

3. A method as claimed in claim 1 or 2 wherein the step of engaging each said element with a respective knitting needle of said one bed comprises moving said elements and said needles relative to one another to bring the tip of each element into the eye of a respective knitting needle.

4. A method as claimed in claim 1 wherein prior to engaging said elements with the needles of said one bed said needles are raised to their tuck position and the step of transferring the knitted loops of said knitted fabric from the needles of said one bed to the intermediate transfer elements comprises returning the knitting needles of said one bed to their initial knitting position.

5. A method as claimed in claim 1 wherein transferring the loops of the knitted fabric from said elements to the needles of said magazine bar comprises engaging each said loop with a respective further transfer element and moving said further transfer elements substantially along said intermediate transfer elements and said needles of the magazine bar to transfer said loops to said needles.

6. A method as claimed in claim 5 wherein said further transfer elements are the teeth of a comb-like member.

7. A method as claimed in claim 5 or 6 wherein said intermediate transfer elements and the needles of the magazine 6 are oriented substantially at right angles to one another and said further transfer elements move in a substantially step-like path.

8. A method as claimed in claim 1 wherein the knitted fabric is disengaged from hooks of a draw-off bar of the knitting machine by means of an elongate member which sweeps over said hooks in the direction of the tips of said hooks to draw said knitted fabric from the hooks.

9. A mechanism for attachment to a flat knitting machine for transferring knitted fabric from the knitting needles of one bed of the machine to the needles of a magazine bar, the mechanism comprising a frame for supporting the beds of said knitting machine, a plurality of intermediate transfer elements movably supported on said frame below said beds; first means for raising said intermediate elements into a first position between said beds and into engagement with said knitting needles and subsequently lowering said elements out of engagement with said knitting needles and into a second, lower position below said beds; a magazine bar movably supported on said frame below said beds, said magazine bar having a plurality of needles thereon; means for moving said magazine bar between a location remote from said second position and a location adjacent said second position for engaging the needles of said magazine bar with said intermediate transfer elements; sweep means movably mounted on said frame adjacent said second position; and means for moving said sweep means along a predetermined path for sweeping the loops of said knitted fabric from said intermediate transfer elements onto the needles of said magazine bar when said elements are engaged with the needles of said magazine bar.

10. A mechanism as claimed in claim 9 wherein said first means comprises means for displacing said one bed of the knitting machine a preselected distance from a position in which knitting takes place; and means for moving said elements into juxtaposition with the needles of said one bed; said elements and said one bed being further displaceable relative to another to engage the tip of each element in the eye of a respective knitting needle.

11. A mechanism as claimed in claim 10 wherein said first means is operable for displacing said one bed both in he direction of its longitudinal axis an amount substantially equal to half the distance separating adjacent needles of the bed, and also in a direction substantially perpendicular to said axis and in the plane of the bed.

12. A mechanism as claimed in claim 10, 11 or 9 wherein said sweep means comprises a plurality of further transfer elements for engaging the loops of said knitted fabric, and carrying said loops onto the needles of said magazine bar.

13. A mechanism as claimed in claim 9 wherein each said intermediate transfer element is in the form of a needle having a free end portion which extends at an acute angle to the body of the needle.

14. A mechanism as claimed in claim 13 wherein each needle of the magazine bar has a recess formed in its free end portion for receiving the end portion of a respective intermediate transfer element.

15. A mechanism as claimed in claim 13 wherein each said intermediate transfer element has a stop formed adjacent its free end portion for supporting a loop of the knitted fabric.

16. A flat knitting machine having a mechanism as claimed in claim 9.

17. A mechanism as claimed in claim 12 wherein said sweep means comprises a comb-like member which has a plurality of teeth serving as said further transfer elements.

* * * * *